United States Patent [19]

Visser

[11] Patent Number: 4,842,123

[45] Date of Patent: Jun. 27, 1989

[54] APPARATUS FOR PROCESSING OBJECTS POSITIONED ON A CONVEYOR BELT

[75] Inventor: Friedrich W. Visser, Zaandam, Netherlands

[73] Assignee: Buhrs-Zaandam B.V., Netherlands

[21] Appl. No.: 159,724

[22] Filed: Feb. 24, 1988

[30] Foreign Application Priority Data

Mar. 4, 1987 [NL] Netherlands ..... 8700525

[51] Int. Cl.[4] ..... B65G 43/00

[52] U.S. Cl. ..... 198/341; 901/7

[58] Field of Search ..... 198/341; 901/7; 53/52, 53/75, 77, 550

[56] References Cited

U.S. PATENT DOCUMENTS 3,283,918 11/1966 Devol ..... 98/341 X
3,958,682 5/1976 Martin ..... 901/7 X
4,086,522 4/1978 Engelberger et al. ..... 901/7 X
4,269,298 5/1981 Mergl ..... 198/341

*Primary Examiner*—Robert J. Spar
*Assistant Examiner*—James R. Bidwell
*Attorney, Agent, or Firm*—Kane, Dalsimer, Sullivan, Kurucz, Levy, Eisele and Richard

[57] ABSTRACT

In an apparatus for processing objects positioned on a conveyor belt by way of a processing device that moves to and fro in parallel to the conveyor belt a correction mechanism is provided for controlling the relative position of the processing device and the object. The correction mechanism can comprise two detection devices for detecting the position of the objects and the processing device, respectively, and a control unit for, in relation to the signals of the detection devices, changing the position of the processing device.

6 Claims, 2 Drawing Sheets

APPARATUS FOR PROCESSING OBJECTS POSITIONED ON A CONVEYOR BELT

The invention relates to an apparatus for processing objects positioned on a conveyor belt, comprising a processing device that for carrying out the process is movable to and fro substantially in parallel to the conveyor belt and that during at least a part of its forward processing stroke has the same velocity as the conveyor belt and engages an object to be processed.

A known apparatus of this type relates to a foil wrapper, in which magazines and the like are wrapped in a plastic foil. Hereby the magazines are first positioned on a foil track moving together with the conveyor belt, whereafter the longitudinal edges of this foil track are folded over said magazines and are interconnected. Next, between the successive magazines transversal seals are provided in the foil track and the foil track is cut through there, so that separate wrapped magazines or the like are obtained. In this known apparatus the processing device therefore comprises a seal device that is combined with a device for cutting through the foil track.

It is a disadvantage of this known apparatus that the magazines can slide relative to the conveyor belt. As a result a chance occurs that the position at which the processing device engages the foil track does not correspond with the desired position. Thus it is possible that the processing device engages the objects to be processed instead of a location between successive objects, resulting in rejected objects. Although there exists a synchronisation between the point of time at which the magazines are supplied to the conveyor belt and the point of time at which the processing device carries out its process, during transport of the magazines on the conveyor belt the afore mentioned displacements occur that can disturb the synchronisation. Said displacements mainly are a result of a slip between the magazines and the foil track positioned on the conveyor belt as well as of an elongation of the foil track, especially during starting up and stopping the apparatus. Moreover a variation of the transport velocity of the conveyor belt can have an advantageous influence on the synchronisation between the position of the magazines and the position of the processing device. When the apparatus processes small objects, whereby a larger amount of objects are provided between the location at which these objects are positioned on the conveyor belt and the position at which the processing device carries out its process, the total deviation of the position of the objects at the processing device relative to the desired position can be rather large, so that until now in said known apparatus a rather large distance has to be maintained between successive objects to avoid that the processing device engages the objects instead of between said objects.

Therefore its an object of the invention to provide an apparatus of the type mentioned before eliminating said disadvantage in an easy, but nevertheless simple manner.

Herefore the apparatus according to the invention is characterized by a correction mechanism for correcting the relative position of the processing device and the object to be processed during the processing stroke of the processing device.

When the correction mechanism according to the invention observes a deviation of the position of the processing device relative to the position of the object to be processed compared to the desired position this mechanism enables a correction of said relative position.

Advantageously the correction mechanism is provided with a first detection device for detecting the position of the objects to be processed, a second detection device for detecting the position of the processing device, as well as a control unit for comparing the detection signals generated by said two detection devices and for, in relation therewith, generating a correction signal or changing the position of the processing device. Like this the real position can be compared with a preset desired position, whereafter dependent of the difference between both positions a correction signal for changing the position of the processing device is generated.

In an advantageous embodiment of the apparatus according to the invention the first detecting device comprises detectors for determining the point of time on which the objects to be processed pass a preset location. Hereby it is favourable if the first detecting device is located such that the position of an object to be processed is determined at the point of time on which the preceding object is processed by the processing device. As a result the distance to be travelled by the objects between the first detection device and the processing device is minimized so that at this part of the conveyor belt no or barely any new displacements of the objects relative to the conveyor belt can occur.

In a handy embodiment of the apparatus according to the invention the convyor belt is provided with at least two parallel series of slits extending in the longitudinal direction of the conveyor belt, wherein the slits of the series mutually overlap and wherein a detector cooperates with each series of slits, said detectors being aligned crosswise of the conveyor belt.

The series of slits having mutually overlapping slits as it were form a continuous opening so that detecting an object is possible at each point of time. Like this it is avoided that the conveyor belt has to be shaped as two separate conveyor belts extending beside each other and having there between a continuous slit, for this would be a disadvantageous for correctly guiding a foil track, for example.

Hereafter the invention will be elucidated referring to the drawing, in which an embodiment of the apparatus according to the invention is illustrated.

Figure 1:
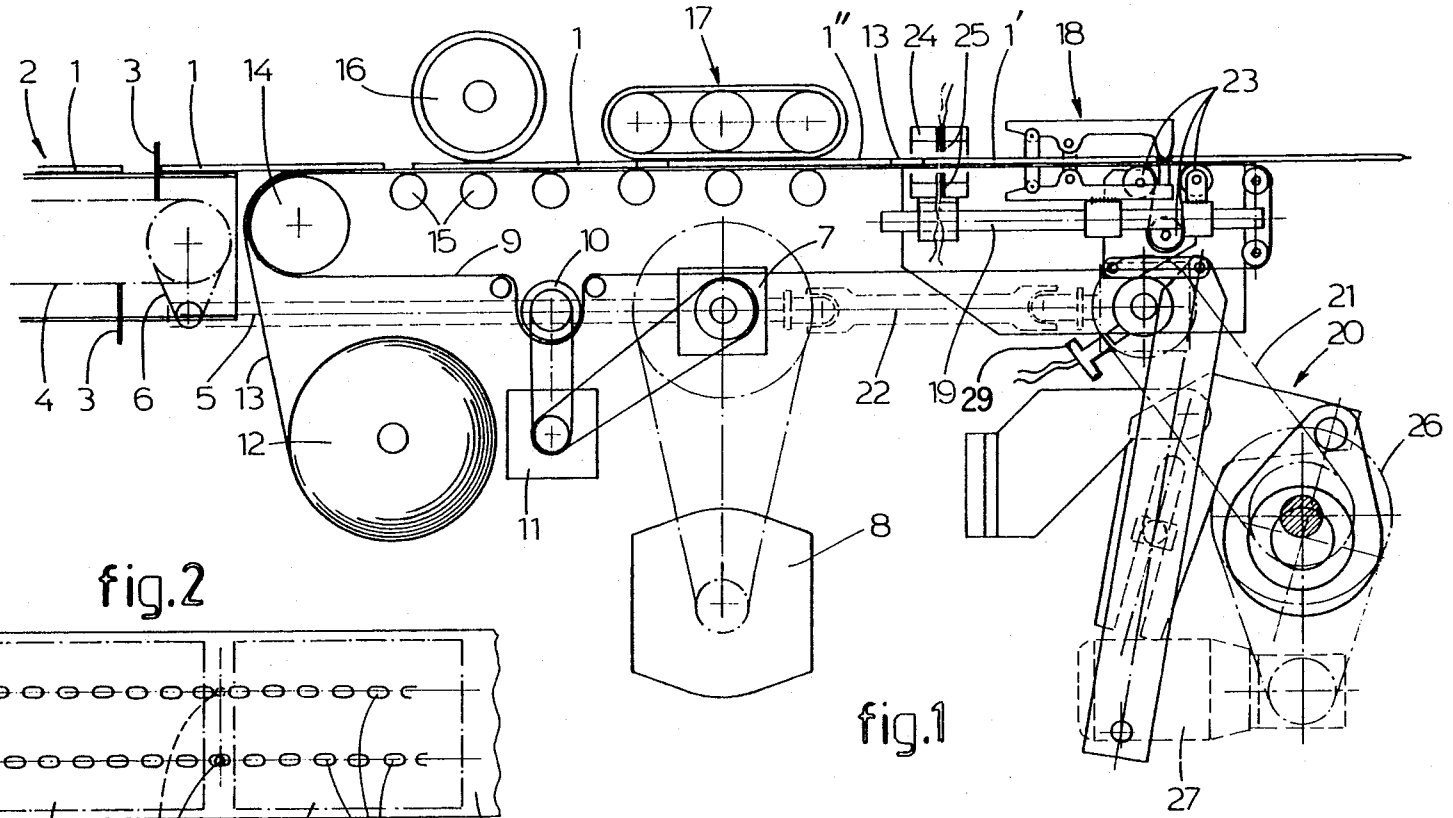
FIG. 1 shows a side elevational view of a part of a first embodiment of the apparatus according to the invention.

In FIG. 1 it is visible that the objects 1 to be processed, such as magazines or the like, are supplied by a supply conveyor 2 with input notches 3. The input notches 3 are connected to a chain 4 and move the objects 1. The drive of the conveyor 2 is obtained by a central drive shaft 5, that at one side is connected to the conveyor 2 by means of a chain 6 and that at its other side is connected to a main drive engine 8 by means of the main drive gear 7.

After leaving the conveyor 2 the magazines 1 reach the conveyor belt 9 that is driven by the drive roll 10. The drive roll 10 too is connected with the main drive gear 7 by means of a settable reduction gear 11. By changing the transmission ratio of the reduction gear 11 the forward velocity of the conveyor belt 9 can be varied without changing the transport velocity of the conveyor 2. As a result the distance between successive magazines 1 on the conveyor belt 9 can be changed.

At the forward end of the conveyor belt 9 also from a roll 12 a plastic foil track 13 is wound off that, for example, via the reverse roll 14 of the conveyor belt 9 is applied below the magazines 1.

In a way not shown further the longitudinal edges of the foil track 13 extending in the longitudinal direction of the conveyor belt 9 are at the upper side of the magazines 1 folded together and interconnected by means of a joint, for example a seal.

In FIG. 1 further are shown: support rolls 15 for the conveyor belt 9, a take-over roll 16 for taking over the magazines 1 coming from the conveyor 2, as well as a pulling and pressing roll unit 17. The operation of these sections is known perse and will therefore not be illustrated in detail.

Further the apparatus comprises a processing device 18 that for carrying out the process is movable to and fro substantially in parallel to the conveyor belt 9 and that during at least a part of its forward processing stroke has the same velocity as the conveyor belt 9 and engages the plastic foil track 13 to be processed. This position is illustrated in FIG. 1. In the embodiment shown the processing device 18 comprises a seal device for applying a transversal seal as well as cutting device for cutting through the plastic foil track 13. During the reverse stroke the processing device 18 does not engage the foil track 13. The operation of this processing device 18 too is known perse and therefore too will not be discussed in detail.

The operating device 18 is movably to and fro beared on a support 19. The to and fro movement of the operating device 18 is caused by a motion mechanism 20 that via a chain 21 and a drive shaft 22 again is connected with the main drive gear 7.

During the to and fro movement of the processing device 18 guide rolls 23 see for a corresponding movement of a loop of the conveyor belt so that the position where the processing device 18 engages the plastic foil track 13 always remains free from the conveyor belt 9.

Figure 2:
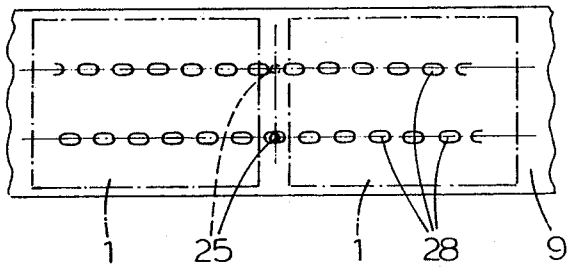
FIG. 2 shows an embodiment of a conveyor belt applied to an apparatus according to the invention.

At a short distance ahead of the processing device 18 a first detection device 24 is provided, comprising detectors for determining the point of time at which the magazines to be processed pass this location. As appears from FIG. 2 the detectors 25 cooperate with two parallel series of slits extending in the longitudinal direction of the conveyor belt 9, in which the slits 28 of the series mutually overlap. Hereby always one detector 25 cooperates with one series of slits 28 whereas both detectors 25 are alined crosswise of the conveyor belt 9. Like this the detectors 25, that are switched in parallel, as it were can "see through" the conveyor belt 9. In the embodiment shown the detectors 25 comprise photoelectric cells, but it is possible to that the detectors comprise glassfibercells or capacitive approach switches.

Further the apparatus comprises a second detection device 29 for detecting the position of the processing device 18. Said second detection device 29, can comprise an approach switch or the like, determining the point of time at which the processing device is in a certain position.

Figure 3:
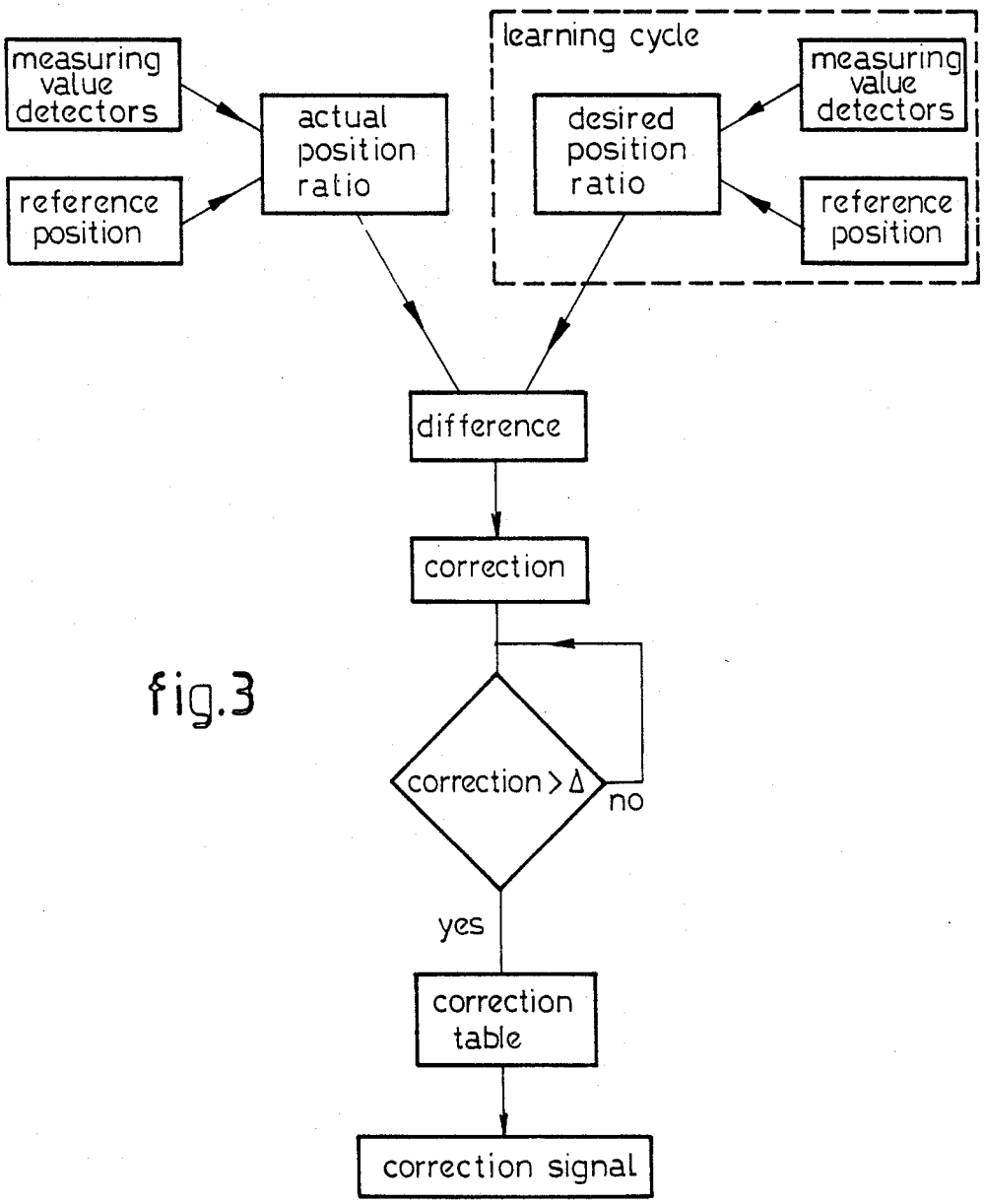
FIG. 3 shows a flow chart of the operation of the apparatus according to the invention.

The operation of the apparatus according to the invention is based on the principle that a control unit, that will be illustrated in detail by means of FIG. 3, is present for comparing the detection signals generated by the two detection devices and for, in relation therewith, generating a correction signal for changing the position of the processing device 18.

The change of the position of the processing device 18 occurs via the motion mechanism 20 that for this reason is provided with an excentric shaft comprising a positioning-differential gear box 26 that is driven by an engine 27. By changing the position of the positioning-differential gear box 26 by means of the engine 27 the phase of the motion cycle of the operating device 18 can be changed over more than 360°, so that the point of time at which the processing device 18 starts with carrying out its process can be chosen freely. The resulting duration of the process does not change.

Therefore it will be clear that by generating an appropriate correction signal to the engine 27 it is possible to change the setting of the differential gear box 26 such that the processing device 18 exactly engages the correct spot of the foil track 13, that is to say between two successive magazines 1.

For determining the desired correction signal one acts as follows.

Dependent of the dimensions of the magazines 1 to be processed, by means of the reduction gear 11 the velocity of the conveyor belt 9 and therefore the mutual distance between the magazines 1 on the conveyor belt 9 is set. Next at a low velocity of the conveyor belt 9 the setting of the differential gear box 26 is, by activating the engine 27, manually changed such that the operating device 18 exactly carries out its process between two successive magazines 1, as represented in FIG. 1. Moreover for a certain phase of the process the position of the processing device relative to a reference position is determined. This relative position defines the so called "desired value" to be pursued during the operation. Further the first detection device 24 is located such that the detectors 25 detect the leading edge of a magazine 1'' when the processing device 18 carries out its process at the preceding magazine 1'. The position of the processing device 18 relative to the reference position at the moment of detection by means of the detectors 25 too is determined. Like this a desired position ratio can be determined between the moment at which the magazine passes the detectors 25 and the moment at which the processing device 18 has reached a certain position (for example the position at which the processing starts). This desired position ratio occurs when a magazine 1 has in the correct relative position relative to the processing device 18. This desired position ratio is stored in the memory of the control unit.

During the actual operation of the apparatus now the real position ratio between the mentioned points of time, so the point of time at which the magazine passes the detection device 24 and the point of time at which the processing device 18 has the mentioned, determined, position, is determined for each magazine. Dependent of the difference between this measured position ratio and the position ratio stored in the memory an activation of the engine 27 occurs so that the phase of the processing device 18 is changed such that the desired position ratio is obtained.

Therefore the control unit compares the actual value of the position ratio with the value thereof stored in the memory. Dependent on the difference between both durations the correction signal for the engine 27 and the differential gear box 26 is determined. Hereby care is taken that only a correction signal will be generated if the difference between the actual and desired position ratio exceeds a certain threshold value. Like this it is avoided that the engine 27 already is activated by very small diversions of the determined position of the magazines relative to the desired position. Moreover the control unit provides the engine 27 with such a correction signal that the velocity with which the setting of the differential gear box 26 is changed depends on the velocity of the conveyor belt 9. When the conveyor belt 9 advances slowly the elapse of time that can be used for changing the setting of the differential gear box 26 is longer, and therefore the setting can occur slower. In contrary a high conveyor belt velocity leads to a quick setting.

A corresponding relation exists between the amount of the correction and the velocity with which this correction occurs. A large correction leads to a quicker setting, whereas a small correction leads to a slower setting.

Referring to FIG. 3 the operation of the apparatus is still illustrated schematically.

The area surrounded by dotted lines indicates the so called learning cycle during which cycle the desired position ratio, that will be stored in the memory of the control unit, is determined. The position of the processing device at the moment of detection of the detectors corresponds with the "measuring value detectors". Comparing this measuring value with a chosen reference position leads to the desired position ratio that is stored in the memory. It is noted, that such a comparison between the measuring values of the detectors and their reference position can be carried out by using a pulse generator, that is coupled to the motion cycle of the apparatus. For instance it is possible to use a pulse generator that, for example, generates 540 pulses during each motion cycle of the processing device. The pulses generated by this pulse generator function as a reference for the moment of detection and as a reference for the moment at which the processing device is in a certain position.

During operation of the apparatus in a corresponding manner the actual position ratio is determined. Hereby for each passing magazine again the measuring value of the detectors is compared with the reference position, leading to an actual position ratio. Next the difference between the desired position and the actual position ratio is calculated. From this difference a correction value is obtained. This correction value is compared with a threshold value $\Delta$. Only when the desired correction exceeds $\Delta$ the resulting correction signal is determined by means of a correction table, in which account is taken for the velocity of the conveyor belt and the magnitude of the correction, said correction signal being applied to the engine for setting the differential gear box.

Carrying out the change of phase of the processing device 18 occurs during the non-active reverse stroke of said processing device, so that the process itself is not hindered.

The invention is not limited to the embodiment described before but can be varied widely within the scope of the invention.

I claim:

1. Apparatus for processing objects positioned on a conveyor belt, comprising a processing device that for carrying out the process is movable to and fro substantially in parallel to the conveyor belt and that during at least a part of its forward processing stroke has the same velocity as the conveyor belt and engages an object to be processed, characterized by a correction mechanism for correcting the relative position of the processing device and the object to be processed during the processing stroke of the processing device, the correction mechanism being provided with a first detection device for detecting the position of the objects to be processed, the first detecting device comprising detectors for determining the point of time on which the objects to be processed pass a pre-set location, the first detecting device being located such that the position of an object to be processed is determined at the point of time on which the preceding object is processed by the processing device, a second detection device for detecting the position of the processing device, as well as a control unit for comparing the detection signals generated by said two detection devices and for in relation therewith generating a correction signal for changing the position of the processing device, the conveyor belt being provided with at least two parallel series of slits extending in the longitudinal direction of the conveyor belt, wherein the slits of the series mutually overlap and wherein a detector cooperates with each series of slits, said detectors being aligned crosswise of the conveyor belt.

2. Apparatus according to claim 1, characterized in that the detectors comprise photoelectric cells.

3. Apparatus according to claim 1, characterized in that the detectors comprise glassfibercells.

4. Apparatus according to claim 1, characterized in that the detectors comprise capacitive approach switches.

5. Apparatus according to claim 1, characterized in that the processing device is provided with a drive comprising an eccentric, wherein the position of the eccentric is adjustable under influence of the correction signal of the control unit.

6. Apparatus according to claim 1, characterized in that the change of position of the processing device occurs during the non-active reverse stroke thereof.

* * * * *